United States Patent [19]

Van Wilson et al.

[11] 4,177,838

[45] Dec. 11, 1979

[54] STOP MOTION SYSTEM FOR HIGH SPEED LOOMS AND THE LIKE

[75] Inventors: Marlin Van Wilson, Barboursville, Va.; Larry C. Nickell, Lewisburg; John L. McCormack, Fairlea, both of W. Va.

[73] Assignee: Appalachian Electronic Instruments, Inc., Ronceverte, W. Va.

[21] Appl. No.: 893,931

[22] Filed: Apr. 6, 1978

[51] Int. Cl.[2] ..... D03D 51/28; G01N 21/28

[52] U.S. Cl. ..... 139/353; 250/561; 139/352

[58] Field of Search ..... 139/336, 352, 353, 370.1, 139/370.2; 250/559, 560, 561 X, 562, 563, 571; 66/157, 161

[56] References Cited

U.S. PATENT DOCUMENTS

| | | | |
|---|---|---|---|
| 3,379,225 | 4/1968 | Ichimi et al. | 139/353 |
| 3,818,236 | 6/1974 | Lind et al. | 250/561 |
| 3,824,401 | 7/1974 | Suzuki | 250/561 |
| 3,833,816 | 9/1974 | Emura et al. | 250/561 |
| 3,902,534 | 9/1975 | Nishiguchi et al. | 139/352 |
| 3,989,068 | 11/1976 | Kakinaka | 193/353 |

FOREIGN PATENT DOCUMENTS

| | | | |
|---|---|---|---|
| 330444 | 4/1956 | Switzerland | 139/352 |

*Primary Examiner*—Henry Jaudon

*Attorney, Agent, or Firm*—Mason, Fenwick & Lawrence

[57] ABSTRACT

Automatic loom stopping apparatus for use with a loom for detecting warp yarn breakage or improper shedding and actuate the loom stop motion means of the loom, comprising light beam emitter and detector means positioned adjacent the warp yarn path toward the supply end from the weaving zone of the loom forming a monitor light beam transversely spanning the open shed, the detector means providing a detector defect signal when any portion of a warp yarn or broken end interrupts the monitor light beam, amplifier and comparator circuitry for producing a processed defect signal responsive to the detector defect signal, timing pulse forming circuitry including a sensor monitoring rotation of the loom drive shaft for producing timing pulses indicating a predetermined phase time in the cycle of operation of the loom applied to a gate control pulse generator to produce short duration window pulses when the shed is in predetermined open condition, and first and second gate circuits conditioned by the window pulses and by start-up delay signals to produce an output signal for stopping the loom when a predetermined number of successive valid defect signals occur.

22 Claims, 4 Drawing Figures

Fig-1
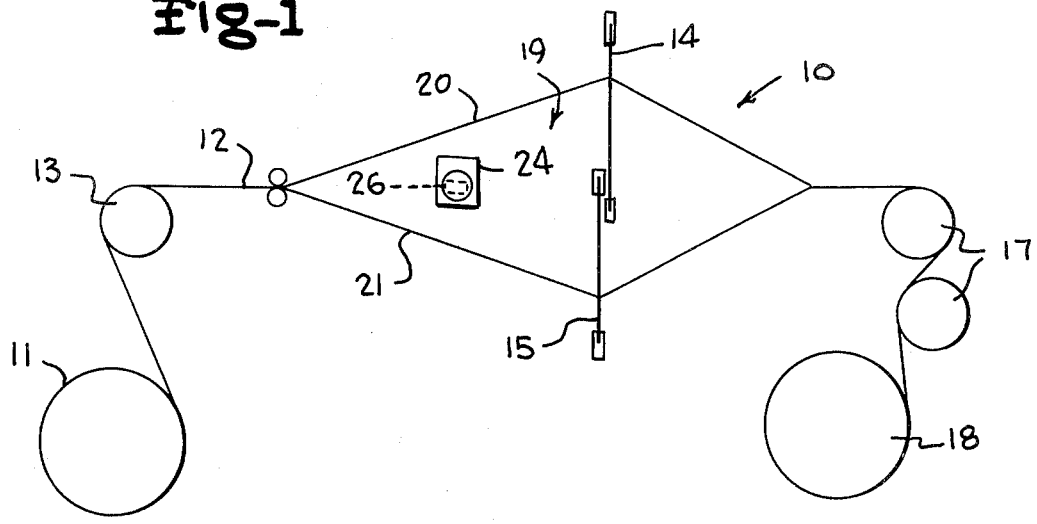
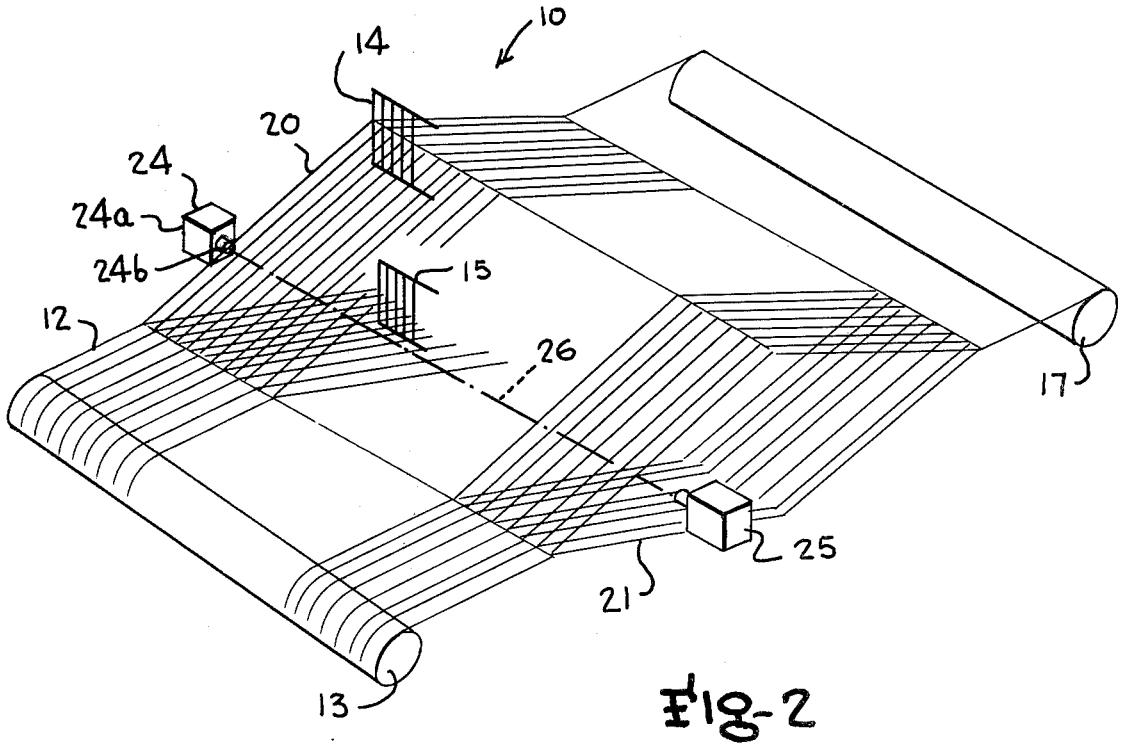
Fig-2

STOP MOTION SYSTEM FOR HIGH SPEED LOOMS AND THE LIKE

BACKGROUND AND OBJECTS OF THE INVENTION

The present invention relates in general to automatic stop motion apparatus for looms for detecting broken warp yarns or threads, and more particularly to electro-optical apparatus for electrically stopping high speed looms when a broken thread defect or the like occurs in the warp threads on the loom in a thread supply direction from the heddle zone by projecting a light beam through the open shed of the warp sheet from one side of the warp sheet and detecting variations in the light beam at the opposite side of the warp sheet by a photoelectric detector head and electronic circuitry which responds only to predetermined light variations occurring when the shed is open to produce a stop signal when an improperly shaded warp occurs.

Heretofore, the most prevalent stop motion apparatus for detecting defects in the warp shed formed by a loom have been of the drop bar or drop wire type, involving a thin flat plate or the like which is suspended for each warp thread at a predetermined location along the warp sheet and is designed to fall from the supporting warp thread or yarn at the time the break of the corresponding warp thread occurs. Usually, the drop wires are positioned behind the heddle frames so that there necessarily occurs a lag in detection and hence in the stopping of the loom, allowing a lag time wherein the breaking end the thread has the opportunity to entangle around the adjacent threads and form an improper warp shed which causes the formation of floats or distortions which disturb regular shading motion of the warp yarns and produce weaving defects in the resultant fabric. Such floats have often prevented the drop wires of the conventional warp stop motion system from falling down, so that the warp stop motion is rendered inoperative in these instances.

More recently, electrical or electro-optical warp loom stop motion systems have been proposed. U.S. Pat. No. 2,279,675 to Gutman discloses a warp stop motion system wherein a beam of light is projected transversely relative to the warp sheet at a position to pass through the open shed when the warp shed is in open position, together with a photoelectric detector and a mechanism which is controlled in timed relation to the rotation of the main drive shaft of the loom and thus in predetermined time relation with the opening of the shed to permit defect signals from the photoelectric detector to operate the loom stop mechanism only when the shed is in a predetermined open condition, thus preventing the photodetector from activating the stop mechanism and producing false stops when the shed is substantially closed. Later U.S. Pat. Nos. 3,379,225 and 3,989,068 have disclosed electro-optical stop motion systems for looms wherein a light beam projector and photodetector are both mounted on the moving sleigh of the loom which executes fore and aft movements through the open space defined by the open shed to detect threads or defects improperly occurring in the open shed during certain portions of the cycle of operation of the loom to produce a loom stopping signal. Of course, the positioning of the light beam producing optics, the photodetector head optics, and such electronic preamplifier circuitry and the like associated with the latter which needs to be mounted on the moving sleigh introduces significant maintenance problems and renders it difficult to provide loom stop motions systems in this manner which remain reliable for relatively long service life periods.

Other systems have been proposed to alleviate the problem encountered in providing a reliable loom stop motion system having adequate service life characteristics such as U.S. Pat. No. 3,818,236 wherein the optical beam is continuously rotated about a horizontal axis along a cylindrical path centered in the open shed and having a large enough diameter to deliberately intersect the upper and lower yarn sheets of the shed four times during each revolution and thereby produce signals which can be processed by circuitry for detecting when additional beam intercepts of thread occur to stop the loom. Also, U.S. Pat. No. 3,902,534 discloses a stop motion system wherein a monitoring light beam is disposed below the lowermost yarn sheet of the shed at the shed opening position and the lowermost yarn sheet is disposed adjacent a rotating brush cylinder close to or in contact with the warp yarn so that when a warp yarn is broken it is immediately arrested by the bristles of the brush and wrapped around the cylinder drawing the broken yarn through the monitoring light beam to activate the stop motion.

An object of the present invention is the provision of a novel stop motion system for looms, wherein a stationary monitoring light beam is projected transversely of the yarn sheet through the open shed and detected by a photodetector head, and wherein novel electronic circuitry is provided for processing the signal produced by the photodetector head to provide an effective processing window for such signals which occurs during a short predetermined time when the shed is open related to the cycle of operation of the loom so as to permit sensing of defect signals only when the shed is in a predetermined open phase, and wherein means are provided to disable the system for producting false stop signals for a predetermined period after machines start up.

Other objects, advantages and capabilities of the present invention will become apparent from the following detailed description, taken in conjunction with the accompanying drawing illustrating a preferred embodiment of the invention.

BRIEF DESCRIPTION OF THE FIGURES

FIG. 1 is a diagrammatic side view of the shed and principal components of a loom incorporating the present invention;

FIG. 2 is a fragmentary perspective view of the shed and the projector and detector units of the optical system associated with the broken yarn monitoring beam;

DETAILED DESCRIPTION OF A PREFERRED EMBODIMENT

Figure 3:
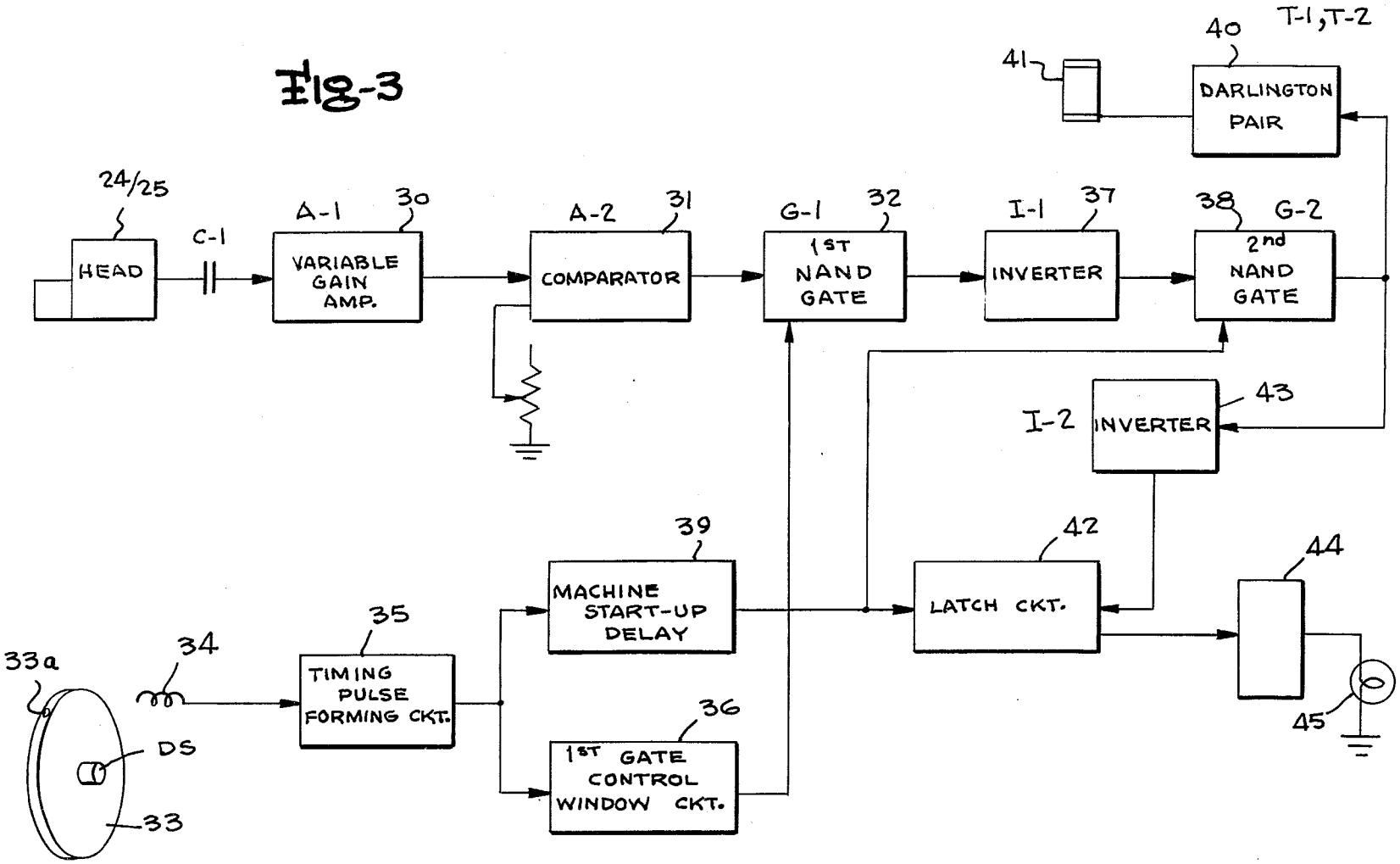
FIG. 3 is a block diagram of the broken yarn detector electronic system.

Referring to the drawings, wherein like reference characters designate corresponding parts or components throughout the several figures, the broken yarn detector and loom stop motion system of the present invention is designed to be used with conventional looms or high speed looms of the water jet type or other known types, such as the loom generally indicated by the reference character 10. Conventionally, such looms comprise a warp beam 11 containing the wound supply of warp yarns or threads for the weaving operation, from which the warp threads are drawn in a supply yarn sheet 12 of many parallel warp yarns in a single plane over a guide roll, sometimes referred to as a whip roll or back beam, indicated at 13, and fed through heddle eyes or the like, of heddles indicated diagrammatically at 14,15 and then through reeds 16 and over a roll or system of rolls, indicated at 17, to the cloth roll 18. The heddles 14,15 are moved vertically in timed relation in a well known manner to raise and lower the alternate subsets or shed sheets of warp yarns to open the shed 19 thus formed between the upper and lower shed sheets of warp yarns indicated at 20 and 21 and change the shed 19 to reverse the positions of the shed sheets of yarns 20,21 between successive passes of the weft yarn across the warp yarn sheet. Thus the shed is closed for two short periods during each cycle of operation as the shed sheets 20,21 pass through the midplane of the shed when the positions of the shed sheets 20,21 are reversed by the raising and lowering of the heddles 14,15.

It will be appreciated that any broken warp yarn ends which occur during the weaving operation upstream of the heddles would either fall by gravity or be swung by shedding movement of the heddles through the space between the upper and lower shed sheets or would become entangled with another warp yarn or yarns and cause improper shedding of the thus entangled warp yarn or yarns.

In order to detect such a falling or abnormally positioned broken yarn end or improper shedding of the entangled unbroken warp yarns, a light beam monitoring system is provided by the present invention to optically monitor the open shed space in a zone located somewhat toward the yarn supply or warp beam end of the loom from the heddles, at a location where the light beam would not be interrupted by shed yarns or warp yarns if no broken ends were to occur when the shed was open, but in a region where any broken yarn ends would either fall through the monitoring light beam or would entangle with adjacent unbroken warp yarns and change their position during shedding in a manner such that they would interrupt the monitoring light beam. As illustrated diagrammatically in FIGS. 1 and 2, the monitoring light beam in the illustrated embodiment is formed by a light projector or transmitter 24 located adjacent one longitudinal side of the warp yarn sheet, for example a light source having a housing **24*a* and lens tube 24*b* and an internal lamp forming a substantially collimated beam or a bundle of light rays having very slight divergence, masked to have a horizontally elongated cross-sectional configuration such that its width is about twice its height by a conventional beam shaping mask in the lens tube. A light detector or receiver, such as a photodetector head 25, is provided adjacent the opposite longitudinal side of the warp yarn sheet in the path of the projected light beam, indicated at 26, to detect variations in the light intensity of the light beam 26 and produce output electrical signals representative of the received light intensity and containing signal variations indicative of any warp yarn interruptions of the monitoring beam 26. For example, an optical system arranged by suitable masking at the projector of the light source to provide a monitoring beam having a cross-sectional width horizontally of about one inch and a vertical height of about one-half inch, located at a position along the warp yarn path toward the supply end where the shed sheets 20,21 have a vertical separation of about one inch has been found to be very satisfactory. Instead of using a separate light projector or transmitter 24 and photodetector 25 at opposite sides of the warp yarn path, one may alternatively use a combination light projector and detector and semi-transparent mirror system, such as the retroreflection detector head disclosed in U.S. Pat. No. 3,530,690 issued to L. C. Nickell et al., at one side of the yarn path and a retroreflective target of the type disclosed in that earlier patent at the opposite side of the warp yarn path, to provide the monitoring beam 26. The monitoring light beam system made up of the projector 24 and photodetector 25, or of a combined light projector and detector at one side of the yarn path and a retroreflective target at the other side, are designed to produce a pulse type signal when a broken end of a warp yarn, or an entangled unbroken warp yarn which is improperly shedded, interrupts the monitoring beam 26. The electrical signal produced by the photodetector will be of a rapidly changing pulse type signal representing progressively less light relative to the light intensity for open shed. The processing of the pulse type signal output from the detector head 25 to prevent false operation of the loom stopping means when the shed is closed or in near closed condition which occurs each time the positions of the shed sheets 20,21 is reversed by the heddles 14,15, and to also prevent false operation of the stop motion system during the period when the loom is just starting initially or after reset following a defect stop, and has not yet reached normal operating conditions, while achieving highly reliable broken yarn detection during shed open phases, is shown in block diagram form in FIG. 3 and in schematic form in FIG. 4**.

Referring now to FIG. 3 showing in block diagram form the electronic circuit for the loom stop motion system of the present invention, a variable gain amplifier 30 is coupled to the detector head 25 through a coupling capacitor C-1 to amplify the pulse type signal generated by the detector head 25 when the broken warp yarn end interrupts the light beam 26 directed through the open shed 19. The monitoring light beam 26, as previously described, may have a vertical dimension of about ½ and a horizontal dimension of about 1 inch, provided by masking of the light beam, and may be located at a position along the yarn path where the upper and lower shed sheets 20,21 have a separation of about 1 inch. The output from the variable gain amplifier 30 is applied to a comparitor 31, providing an output to a first gate 32 which is controlled by a 20 millsecond window pulse from the output of the first gate control window circuit 36. An output generated by the first gate 32 is inverted by inverter circuit 37 and applied to a second gate 38, which is also controlled by the output from the machine's start-up delay circuit 39 or from the latch circuit 42. The output of the second gate circuit 38 is applied to a Darlington pair 40 controlling the stop relay 41 which stops the loom when a broken end is detected, and is also applied to the inverter 43 connected to the latch circuit 42. The latch circuit output is connected to a transistor 44 controlling the alarm lamp 45.

The first gate control window circuit 36 and the machine start-up delay circuit 39 are both supplied with timing pulses from the timing pulse forming circuit 35 receiving pulses from the magnetic sensor 34 adjacent the rotating disc 33 connected to the main drive shaft of the loom, so that the operation of the components of the system is correlated to the operation of the heddles and the start-up of the loom to prevent false stop signals from closed sheds or abnormal loom operation during start-up.

Figure 4:
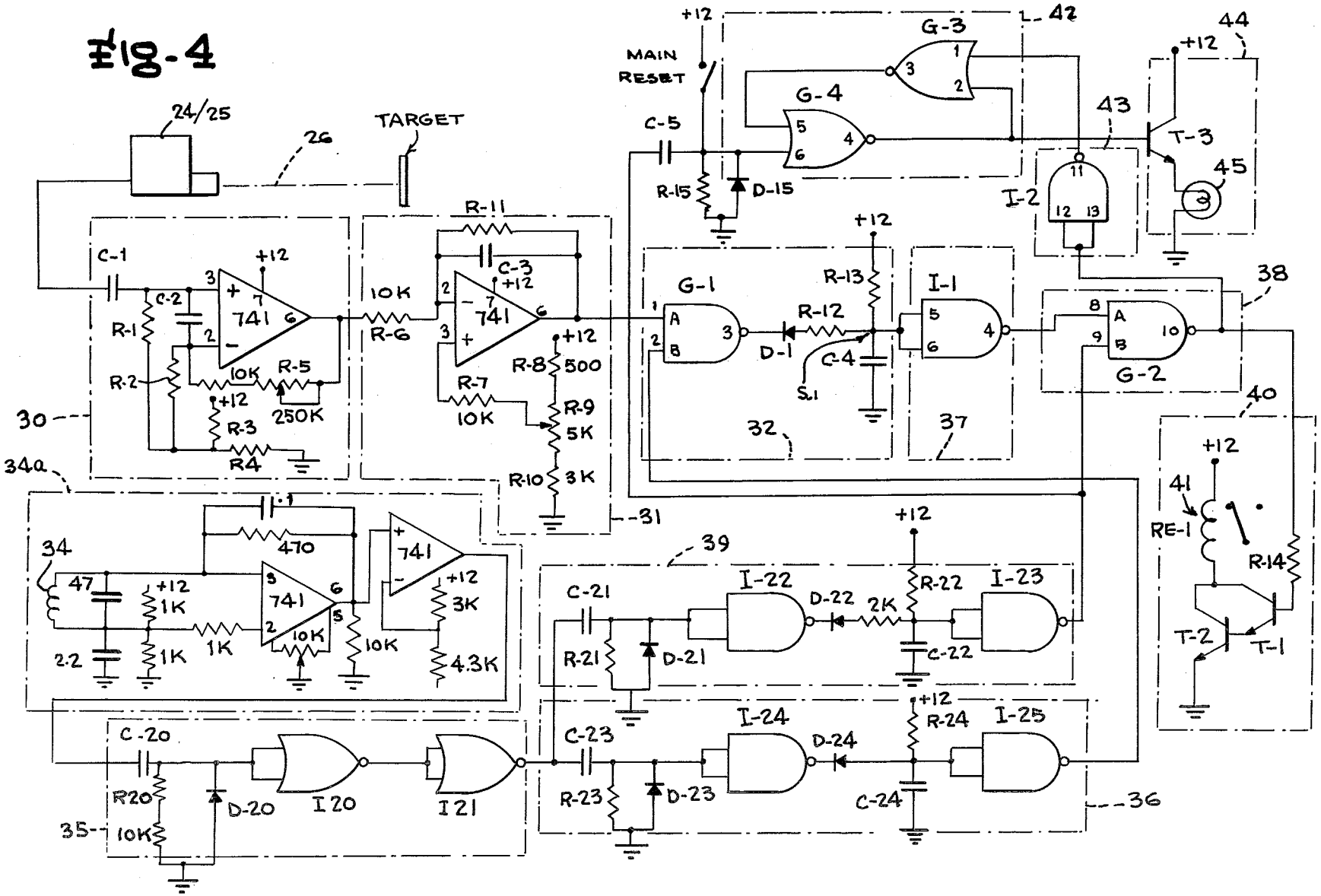
FIG. 4 is a selematic circuit diagram of the electronic system.

More specifically, referring to the schematic circuit of FIG. 4, the variable gain amplifier 30 receives the electrical signal output from the phototransistor or similar light sensitive element in the photodetector head 25 providing a negative-going pulse signal responsive to light beam interruption by a broken end, through capacitor C-1, which is an AC coupling capacitor for passing the waveform without DC bias getting into the effect. The amplifier 30 comprises an operational amplifier A-1 (which may be a UA 741 Op.Amp. made by Fairchild Semiconductor Co.) which is connected to form the variable gain amplifier 30 by the resistors R-1 to R-5 and capacitor C-2. Resistors R-1 and R-2 connected to the input pins 3 and 2 of operational amplifier A-1 insert a DC bias into the amplifier so that the output with zero input is about plus 4 volts in one satisfactory example. The plus 4 volt level is fixed by the resistors R-3 and R-4. The capacitor C-2 connected across the input terminals is provided to prevent oscillations, and the variable resistor R-5 connected between the output pin 6 and the input pin 2 sets the minimum gain at which the amplifier will work. This minimum gain is usually about 0.5. The resistor R-5 allows one to go up to a maximum gain of about 12.5.

The output from the pin 6 of the amplifier A-1 is connected through resistor R-6 to pin 2 of the operational amplifier A-2 connected to form the comparator 31. The operational amplifier A-2 may also be a UA 741 Op. Amp used as a comparator by the connections shown. Resistors R-8, R-9 and R-10 provide a threshold set network for operational amplifier A-2, the resistor R-9 being a potentiometer whose wiper or movable contact is connected through resistor R-7 to the input pin 3 of A-2. The potentiometer R-9 is adjusted to apply a threshold level signal to the plus or pin 3 input for operational amplifier A-2. Resistor R-11 and capacitor C-3 provide an RC feedback circuit to stabilize operational amplifier A-2 against oscillation and permit very high gain amplification without oscillation.

The first gate 32 is formed of a NAND gate G-1, having its input pin 1 connected to the output pin 6 of comparator A-2, which goes to about plus 12 volts when a defect signal is produced or when the shed crosses. The NAND gate G-1 (or negative AND gate) may be part of an RCA integrated circuit CD 4011 AE (having a built-in threshold of several volts). The output pin 3 of the NAND gate G-1 is connected through a diode D-1 and resistor R-12 to the input pins 5 and 6 of another NAND gate portion of the integrated circuit CD 4011 providing the gate G-1, with its inputs connected together to form the inverter I-1 providing the inverter circuit of 37 of FIG. 3. The junction between the resistor R-12 and the input pins of the inverter I-1 are also connected to resistor R-13 and capacitor C-4. Low voltage at the output of gate G-1 causes current flow through resistor R-13 and resistor R-12 and brings the voltage at the point S-1 upon occurrence of a chosen number of successive defect pulses to a level below the threshold of inverter I-1. In one satisfactory example, the capacitor C-4 is chosen to require five successive defect pulses to trigger inverter I-1 and thus to reach its threshold. The gate G-2 is formed of another NAND gate portion of the integrated circuit CD 4011 from which the gate G-1 and inverter I-1 are formed, and the second inverter I-2, forming the inverter stages 43 of FIG. 3 is also formed from the CD 4011 and connected to the output of the gate G-2. Inverter I-1 is normally in a logic zero or near zero condition and when triggered, provides a logic 1 at the output. It will be appreciated that as long as defect pulses produced at the detector head output by yarn interrupting the beam 26 keep coming, the capacitor C-4 charges to a level keeping the inverter I-1 input low and producing a DC-like output positive pulse from I-1. When capacitor C-4 charges to the level produced by five successive defect pulses, in the described example, the inverter I-1 is triggered, producing a positive signal out which is a valid defect signal (not a shed crossing). This cuts down false stops which may arise as a result of drops of water on the yarn, fuzz, fly, and so forth.

The positive output from inverter I-1 applied to the gate G-2 forms a valid defect signal at the input A or pin 8 of gate G-2. The input at input B or pin 9 of gate G-2 is an automatic reset delay (positive after 2–3 seconds of machine running by counting pulses from the drive shaft monitor) and produces a negative going pulse of less than 1 volt.

The output or negative going pulse from gate G-2 is directed through two processing paths. In the first direction, the negative validated defect pulse from gate G-2 through resistor R-14 to the base of transistor T-1 of the Darlington pair (a 2N 4424), cutting current off of the transistors T-1 and T-2 and thus cutting off current through the stop relay 41.

In the second direction, the negative validated defect pulse from gate G-2 is applied to the input of inverter I-2. The inverted pulse is applied to the input No. 1 of NOR gate G-3 forming a latch circuit with NOR gate G-4. When pin 1 of gate G-3 is high, output 3 goes low and is applied to pin 5 of gate G-4, applying a high from pin 4 to pin 2 of G-3 and latching G-3 on. A high on input pin 4 of gate G-4 to the base of transistor T-3 turns it on energizing the indicator lamp 45.

It will be appreciated that the timing of the open periods or "gate window periods" for the first and second gates 32 and 38 must be properly correlated with the cycle of operation of the loom mechanism to limit the signal passing or open window periods of the gates to times when the shed 19 is in such open condition that the monitoring light beam 26 is not interrupted by any portions of the yarns forming the upper or lower shed sheets 20, 21 unless a broken end falls into the light beam or entanglement produces improper shedding. Also, the system should be disabled from indicating improper shedding or broken ends during the few seconds following initial start-up or reset start-up of the loom mechanism before the timing of loom machinery functions has stabilized at normal operating condition. This timing correlation is achieved by generating periodic timing signal pulses indicating rotation of the main drive shaft of the loom, for example by means of a magnetic drive shaft rotation sensor comprising a plastic disc 33 fixed on the main drive shaft DS of the loom having a permanent magnet 33*a*, or a steel plug, at a chosen circumferential location, or a plurality of magnets or steel plugs at uniformly spaced circumferentially spaced locations, on the periphery of the disc 33 to activate a stationary pick-up coil 34 located adjacent the disc periphery to produce one electrical pulse per revolution, or plural pulses per revolution if plural magnets or steel plugs are used, in the electrical lead from the pick-up coil 34. In the illustrated embodiment, a side-by-side magnet pair 33*a* is provided in the rotating timing disc 33, which produces a positive and negative pulse waveform each time the magnet pair 33*a* passes the pick-up coil 34, and conventional circuitry illustrated schematically at 34*a* is provided to remove the negative pulse portion, and amplify and square up the pulse waveform to provide a timing pulse train of positive pulses, one pulse per revolution of the main drive shaft and timing disc 33, to the timing pulse forming circuit 35, forming the first stage of the gate control and start-up disabling circuits formed by stages 35, 36 and 39 of FIG. 3. The timing pulse forming circuit 35 includes the capacitor C-20, resistor R-20 and diode D-20 forming a differentiating circuit to change a long pulse from the magnetic sensor coil 34 into a one millisecond wide negative pulse at the output of inverter I-20, inverted to a one millisecond positive pulse at the output of inverter I-21. This is applied through capacitor C-21 and is differentiated at capacitor C-21 and resistor R-21 and diode D-21 and inverted by inverter I-22, which with inverter I-23 form the machine start-up delay circuit 39. When the output of inverter I-22 is a negative pulse at more than 200 R.P.M. of the drive shaft (one pulse every 0.3 seconds), capacitor C-22 charges down to a level to cause inverter I-23 output to go positive.

A positive pulse is also applied to a differentiating circuit formed by C-23, R-23 and D-23 and inverted by I-24 forming most of the first gate control window circuit 36 of FIG. 3. When the output of inverter I-24 goes negative, capacitor C-24 charges and the top of C-24 goes to plus 0.6 volts and stays until the input pulse ends, and capacitor C-24 starts towards plus 12 volts. Voltage at the input of inverter I-25 rises to the threshold of inverter I-25, to produce a positive output pulse of 20 milliseconds duration.

In the operation of the circuitry, the timing pulse forming circuit 35 and machine start-up delay circuit 39 serve during the first two to three seconds following initial start-up of the loom or start-up following a loom stop and reset, to render gate G-2 unable to produce an output which would operate the stop relay or defect indicator lamp even if a valid defect signal occurs at the output of inverter I-1. To accomplish this, the relatively long pulse generated by the timing pulse generating means associated with this loom drive shaft for example by the magnetic pick-up coil and rotating disc 33 or electo-optical pulse generator system, is changed by the differentiating circuit formed by capacitor C-20, resistor R-20 and diode D-20 into a 1 millisecond wide negative pulse at the output of the NOR circuit connected as inverter I-20, which is then inverted by the NOR circuit connected to form inverter I-21 to provide a one millisecond wide positive pulse to be applied to the circuits 39 and 36.

The one millisecond positive pulses, one per revolution of the loom drive shaft in the illustrated example, applied to the differentiating circuit formed by capacitor C-21, resistor R-21 and diode D-21 of the machine start-up delay circuit 39 produces a positive differentiated spike applied to the NAND circuit connected to form inverter I-22 causing the output of I-22 to produce a negative pulse for each pulse from I-21. When the speed of rotation of the loom drive shaft upon start-up gets above 200 R.P.M., the negative output pulses from I-22 occur every 0.3 seconds or faster, causing capacitor C-22 to charge down to a level to cause inverter I-23 to produce output above about +10 volts. This occurs about 2–3 second after loom start-up. The positive voltage signal at the output of I-23 is applied to input pin 9 of gate G-2, providing input B, to condition gate G-2 so that it can respond to valid defect signals on its input A (pin 8) and cause operation of the stop relay RE-1 and indicator lamp 45. The leading edge of the waveform of the I-23 output when it goes positive is also applied to the differentiating network formed by C-5, R-15 and D-15 which produces a positive differentiated pulse or spike at input pin 6 or NOR gate G-4 in the latch circuit 42 insuring that it is properly reset. Reset is effected by closing normal reset switch S-MR which applies +12 volts to pin 6 of gate G-4.

The positive pulse output from inverter I-21 is also applied to the differentiating network formed by capacitor C-23, resistor R-23 and diode D-23 in the gate control window circuit 36, producing a differentiated positive pulse at the leading edge fed to the NAND circuit connected as inverter I-24. When the output of inverter I-24 goes negative responsive to the positive input pulse, the top of capacitor C-24 goes to about +0.6 volts and stays at that level until the input pulse ends and capacitor C-24 starts toward +12 volts, and when it rises to the threshold of I-25 the output of I-25 which went high at the leading edge of the input pulse from I-24 goes low, terminating the output pulse from I-25 and thus producing a positive output pulse of 20 millisecond duration as a gate control window pulse for the input B (at pin 2) of gate G-1. This window pulse forms a synchronizing pulse for the gate G-1 indicating the middle of the dwell when the shed is wide open and limiting the operative period of the gate G-1 to the short 20 millisecond period when the shed is in this wide open condition.

If a broken warp yarn end falls through the monitoring light beam 26 or improper shedding occurs because of entanglement of a broken end in the warp yarn sheet positioning any yarns in the sheet to interrupt the monitoring beam, the intensity of light received at the phototransistor or other light sensor in the detector head 25 is reduced during open shed phase producing a pulse type signal which is coupled through capacitor C-1 to the positive input of the variable gain amplifier A-1. The output of amplifier A-1, which is normally at about +4 volts with zero input, goes to a higher positive voltage level determined by the gain established by the setting of R-5, sufficient to cause the comparator A-2 to apply a positive pulse to the A input (pin 1) of gate G-1. If the positive pulse to input A of gate G-1 occurs while the 20 millisecond window pulse from I-25 is on input B of gate G-1, indicating wide open shed timing the output of gate G-1 will go low. The low voltage at gate G-1 output causes current flow through resistors R-13 and R-12, bringing the voltage at point S-1 at the top of capacitor C-4 and input of I-1 down during the time each such low voltage pulse occurs at the output of gate G-1. Capacitor C-4 is such as to require about 5 successive low pulses in the illustrated example at gate G-1 output to bring the voltage at point S-1 down low enough to trigger inverter I-1 and cause I-1 to produce a logic one positive pulse on input A of gate G-2. As long as the defect pulses continue to arrive at input A of gate G-1 during window pulses on input B of gate G-1, capacitor C-4 continues to charge to a level keeping the I-1 input low and producing a DC like output positive pulse.

The resulting negative validated defect pulse from gate G-2 is applied through resistor R-14 to the base of T-1 of the Darlington pair 40, cutting current off through the stop relay RE-1 and switching its contacts to stop the loom. This negative validated defect pulse, applied to I-2, also triggers NOR gate G-3 on by making its pin 1 go high, the resulting low on pin 3 is applied to pin 5 or NOR gate G-4, applying a high from its pin 4 to pin 2 of G-3 and thus latching G-3 on, and turning T-3 on to energize lamp 45.

The following is a table of representative values for resistors and capacitors and solid state elements in a satisfactory example of the circuit.

| | | | |
|---|---|---|---|
| R-1 | 20K | C-1 | 47μ |
| R-2 | 20K | C-2 | 100μ |
| R-3 | 2K | C-3 | 100μ |
| R-4 | 1K | C-4 | 10μ |
| R-5 | 250K | C-5 | .1μ |
| R-6 | 10K | C-20 | .1μ |
| R-7 | 10K | C-21 | .1μ |
| R-8 | 500 | C-22 | 2.2μ |
| R-9 | 5K | C-23 | .1μ |
| R-10 | 3K | C-24 | 1μ |
| R-11 | 100K | A-1 | UA 741 |
| R-12 | 13K | A-2 | UA 741 |
| R-13 | 680K | T-1 | 2N4424 |
| R-14 | 2K | T-2 | TP 55 |
| R-15 | 33K | T-3 | 2N5308 |
| R-20 | 10K | | |
| R-21 | 33K | | |
| R-22 | 600K | | |
| R-23 | 62K | | |
| R-24 | 200K | | |

The gates G-1 and G-2, and inverters I-1 and I-2 may be formed from a single CD4011AE integrated circuit, the four inverters I-22 to I-25 may also be formed from a CD4011AE integrated circuit, and the inverters I-20 and I-21 and gates G-3 and G-4 may be formed from a CD4001AE integrated circuit.

What is claimed is:

1. Automatic loom stopping apparatus to be associated with a loom wherein warp yarns are shedded periodically to open shed condition during weaving for detecting yarn defects arising from warp yarn breakage or improper shedding and actuate loom stop motion means of the loom upon occurrence of such yarn defects, comprising monitor light beam forming means including light beam emitter and detector means positioned adjacent the warp yarn path from the supply end to the weaving zone of the loom to direct the monitor light beam through the open shed along a substantially horizontal transverse light path generally perpendicular to the warp yarns, the detector means providing a detector defect signal when any portion of a warp yarn or broken end interrupts the monitor light beam, signal processing means including amplifier means for producing a processed defect signal responsive to said detector defect signal, timing pulse forming means including rotation sensing means monitoring rotation of a drive shaft of the loom for producing timing pulses indicating a predetermined phase time in the cycle of operation of the loom, a gate control pulse generator for producing short duration window pulses responsive to said timing pulses to indicate times when the shed is in predetermined open condition, a first gate circuit receiving said processed defect signals and said window pulses for producing a first gated defect signal when said yarn defects occur during the open shed periods signified by the window pulses, start-up delay signal means responsive to said timing pulses for producing a gate enable signal commencing at a delay time following loom start-up when the timing pulses occur at a predetermined frequency, a second gate circuit responsive to concurrence of said gate enable signals and said first gated defect signals to produce output stop signals, and stop relay means activated by said output stop signals to stop the loom.

2. Automatic loom stopping apparatus as defined in claim 1, wherein said signal processing means includes a comparator circuit receiving signals from said amplifer means and having a threshold set network including an adjustable potentiometer establishing a threshold voltage level which signals from the amplifier means must exceed to produce said processed defect signal applied to said first gate circuit.

3. Automatic loom stopping apparatus as defined in claim 2, wherein said amplifier means included in said signal processing means is an operational amplifier connected as a variable gain amplifier having an adjustable potentiometer connected between its output and input.

4. Automatic loom stopping apparatus as defined in claim 2, wherein said rotation sensing means monitoring rotation of the loom drive shaft comprises a plastic disc fixed on the loom drive shaft having a plug of metallic material at a predetermined position along the perimeter thereof and a stationary magnetic sensor coil located adjacent the periphery of the disc to cause an AC type pulse signal to be generated by the coil in predetermined time relation to revolution of the disc, and said timing pulse forming means including pulse processing circuitry for producing a sharp positive pulse of about 1 millisecond duration, and said gate control pulse generator having means responsive to said sharp positive pulse to produce a positive window pulse of about 20 milliseconds duration timed to occur when the shed is in wide open condition.

5. Automatic loom stopping apparatus as defined in claim 2, wherein validating circuit means interposed between said first gate circuit and said second gate circuit for receiving said first gated defect signals indicating yarn defect interruption of the monitor beam and requiring a predetermined number of successive first gated defect signals to activate said second gate circuit to produce said output stop signals.

6. Automatic loom stopping apparatus as defined in claim 5 wherein said validating circuit means includes a capacitor to which said first gated defect signals are applied which charges to a predetermined voltage level upon occurrence of a predetermined number of successive first gated defect signals applied thereto and an inverter connected to said capacitor to be triggered when the capacitor charges to said predetermined level and produce a valid defect output signal operative to activate said second gate circuit to produce said output stop signals upon concurrence with said gate enable signals.

7. Automatic loom stopping apparatus as defined in claim 6, wherein said amplifier means included in said signal processing means is an operational amplifier connected as a variable gain amplifier having an adjustable potentiometer connected between its output and input.

8. Automatic loom stopping apparatus as defined in claim 1, including validating circuit means interposed between said first gate circuit and said second gate circuit for receiving said first gated defect signals indicating yarn defect interruption of the monitor beam and requiring a predetermined number of successive first gated defect signals to activate said second gate circuit to produce said output stop signals.

9. Automatic loom stopping apparatus as defined in claim 8, wherein said amplifier means included in said signal processing means is an operational amplifier connected as a variable gain amplifier having an adjustable potentiometer connected between its output and input.

10. Automatic loom stopping apparatus as defined in claim 9, wherein said signal processing means includes a comparator circuit connected to receive output signals from said amplifier means and having an adjustable potentiometer for establishing a threshold signal level at the input thereof to cause the signal processing means to produce said processed defect signals only when output signals from the amplifier means exceed a predetermined threshold level, said comparator being formed of an operational amplifier with said potentiometer connected between its output and one of its inputs and the other input thereof being connected to the output of said amplifier means.

11. Automatic loom stopping apparatus as defined in claim 8, wherein said signal processing means includes a comparator circuit connected to receive output signals from said amplifier means and having an adjustable potentiometer for establishing a threshold signal level at the input thereof to cause the signal processing means to produce said processed defect signals only when output signals from the amplifier means exceed a predetermined threshold level, said comparator being formed of an operational amplifier with said potentiometer connected between its output and one of its inputs and the other in-ut thereof being connected to the output of said amplifier means.

12. Automatic loom stopping apparatus as defined in claim 8, wherein said validating circuit means includes a capacitor to which said first gated defect signals are applied which charges to a predetermined voltage level upon occurrence of a predetermined number of successive first gated defect signals applied thereto and an inverter connected to said capacitor to be triggered when the capacitor charges to said predetermined level and produce a valid defect output signal operative to activate said second gate circuit to produce said output stop signals upon concurrence with said gate enable signals.

13. Automatic loom stopping apparatus as defined in claim 12, wherein said amplifier means included in said signal processing means is an operational amplifier connected as a variable gain amplifier having an adjustable potentiometer connected between its output and input.

14. Automatic loom stopping apparatus as defined in claim 12, wherein said signal processing means includes a comparator circuit connected to receive output signals from said amplifier means and having an adjustable potentiometer for establishing a threshold signal level at the input thereof to cause the signal processing means to produce said processed defect signals only when output signals from the amplifier means exceed a predetermined threshold level, said comparator being formed of an operational amplifier with said potentiometer connected between its output and one of its inputs and the other input thereof being connected to the output of said amplifier means.

15. Automatic loom stopping apparatus as defined in claim 12, wherein said rotation sensing means monitoring rotation of the loom drive shaft comprises a plastic disc fixed on the loom drive shaft having a plug of metallic material at a predetermined position along the perimeter thereof and a stationary magnetic sensor coil located adjacent the periphery of the disc to cause an AC type pulse signal to be generated by the coil in predetermined time relation to revolution of the disc, and said timing pulse forming means including pulse processing circuitry for producing a sharp positive pulse of about 1 millisecond duration, and said gate control pulse generator having means responsive to said sharp positive pulse to produce a positive window pulse of about 20 milliseconds duration timed to occur when the shed is in wide open condition.

16. Automatic loom stopping apparatus as defined in claim 1, wherein said amplifier means included in said signal processing means is an operational amplifier connected as a variable gain amplifier having an adjustable potentiometer connected between its output and input.

17. Automatic loom stopping apparatus as defined in claim 16, wherein said rotation sensing means monitoring rotation of the loom drive shaft comprises a plastic disc fixed on the loom drive shaft having a plug of metallic material at a predetermined position along the perimeter thereof and a stationary magnetic sensor coil located adjacent the periphery of the disc to cause an AC type pulse signal to be generated by the coil in predetermined time relation to revolution of the disc, and said timing pulse forming means including pulse processing circuitry for producing a sharp positive pulse of about 1 millisecond duration, and said gate control pulse generator having means responsive to said sharp positive pulse to produce a positive window pulse of about 20 milliseconds duration timed to occur when the shed is in wide open condition.

18. Automatic loom stopping apparatus as defined in claim 16, wherein said signal processing means includes a comparator circuit connected to receive output signals from said amplifier means and having an adjustable potentiometer for establishing a threshold signal level at the input thereof to cause the signal processing means to produce said processed defect signals only when output signals from the amplifier means exceed a predetermined threshold level, said comparator being formed of an operational amplifier with said potentiometer connected between its output and one of its inputs and the other input thereof being connected to the output of said amplifier means.

19. Automatic loom stopping apparatus as defined in claim 18, wherein said rotation sensing means monitoring rotation of the loom drive shaft comprises a plastic disc fixed on the loom drive shaft having a plug of metallic material at a predetermined position along the perimeter thereof and a stationary magnetic sensor coil located adjacent the periphery of the disc to cause an AC type pulse signal to be generated by the coil in predetermined time relation to revolution of the disc, and said timing pulse forming means including pulse processing circuitry for producing a sharp positive pulse of about 1 millisecond duration, and said gate control pulse generator having means responsive to said sharp positive pulse to produce a positive window pulse of about 20 milliseconds duration timed to occur when the shed is in wide open condition.

20. Automatic loom stopping apparatus as defined in claim 1, wherein said signal processing means includes a comparator circuit connected to receive output signals from said amplifier means and having an adjustable potentiometer for establishing a threshold signal level at the input thereof to cause the signal processing means to produce said processed defect signals only when output signals from the amplifier means exceed a predetermined threshold level, said comparator being formed of an operational amplifier with said potentiometer connected between its output and one of its inputs and the other input thereof being connected to the output of said amplifier means.

21. Automatic loom stopping apparatus as defined in claim 20, wherein said rotation sensing means monitoring rotation of the loom drive shaft comprises a plastic disc fixed on the loom drive shaft having a plug of metallic material at a predetermined position along the perimeter thereof and a stationary magnetic sensor coil located adjacent the periphery of the disc to cause an AC type pulse signal to be generated to be generated by the coil in predetermined time relation to revolution of the disc, and said timing pulse forming means including pulse processing circuitry for producing a sharp positive pulse of about 1 millisecond duration, and said gate control pulse generator having means responsive to said sharp positive pulse to produce a positive window pulse of about 20 milliseconds duration timed to occur when the shed is in wide open condition.

22. Automatic loom stopping apparatus as defined in claim 1, wherein said rotation sensing means monitoring rotation of the loom drive shaft comprises a plastic disc fixed on the loom drive shaft having a plug of metallic material at a predetermined position along the perimeter thereof and a stationary magnetic sensor coil located adjacent the periphery of the disc to cause an AC type signal to be generated by the coil in predetermined time relation to revolution of the disc, and said timing pulse forming means including pulse processing circuitry for producing a sharp positive pulse of about 1 millisecond duration, and said gate control pulse generator having means responsive to said sharp positive pulse to produce a positive window pulse of about 20 milliseconds duration timed to occur when the shed is in wide open condition.

* * * * *